US012215560B2

(12) United States Patent
Tovar Cardona

(10) Patent No.: US 12,215,560 B2
(45) Date of Patent: Feb. 4, 2025

(54) SEAL THAT EMBRACES THE ELECTRICAL CONDUCTORS THAT CROSS THROUGH THE WELLHEAD AND DEVICE COMPRISING THE SAME

(71) Applicant: Santiago Tovar Cardona, Cundinamarca (CO)

(72) Inventor: Santiago Tovar Cardona, Cundinamarca (CO)

( * ) Notice: Subject to any disclaimer, the term of this patent is extended or adjusted under 35 U.S.C. 154(b) by 0 days.

(21) Appl. No.: 17/788,059

(22) PCT Filed: Dec. 28, 2020

(86) PCT No.: PCT/IB2020/062499
§ 371 (c)(1),
(2) Date: Jun. 22, 2022

(87) PCT Pub. No.: WO2021/137141
PCT Pub. Date: Jul. 8, 2021

(65) Prior Publication Data

US 2023/0069854 A1 Mar. 9, 2023

(30) Foreign Application Priority Data

Dec. 31, 2019 (CO) ..... 2019/0015116

(51) Int. Cl.
*H02G 15/013* (2006.01)
*E21B 33/04* (2006.01)
*H02G 3/18* (2006.01)
*H02G 15/04* (2006.01)
*H02G 15/08* (2006.01)

(52) U.S. Cl.
CPC ..... *E21B 33/0407* (2013.01); *E21B 33/0422* (2013.01)

(58) Field of Classification Search
USPC ..... 166/75.14
See application file for complete search history.

(56) References Cited

U.S. PATENT DOCUMENTS 2,922,836 A * 1/1960 Brown ..... H02G 3/088 277/606
4,409,430 A * 10/1983 Boscher ..... H02G 15/192 174/92
5,258,578 A * 11/1993 Smith ..... H02G 15/013 174/92
5,258,678 A * 11/1993 Futami ..... H02K 1/276 29/598

(Continued)

*Primary Examiner* — Matthew R Buck
*Assistant Examiner* — Douglas S Wood
(74) *Attorney, Agent, or Firm* — Eugenio J. Torres-Oyola; Victor M. Rodriguez-Reyes; Rafael Rodriguez-Muriel

(57) ABSTRACT

The present invention relates to an elastomeric seal that embraces the electrical conductors that pass through the wellhead and comprises an upper cylindrical portion, a lower frustoconical portion, one to three through holes longitudinally crossing the seal and one to three longitudinal cuts that go from the periphery of said through holes to the seal periphery. In an alternative of the invention, the seal comprises more than one through holes, one longitudinal cut that goes from the periphery of one of the through holes to the periphery of the seal and one or two longitudinal cuts that go from the periphery of one of said through holes to the periphery another through hole.

12 Claims, 10 Drawing Sheets

(56) References Cited

U.S. PATENT DOCUMENTS

| | | | | |
|---|---|---|---|---|
| 5,792,989 | A * | 8/1998 | Smith | H02G 15/013 174/92 |
| 6,118,076 | A * | 9/2000 | Damm | H02G 15/113 174/92 |
| 7,049,515 | B1 * | 5/2006 | Collins | H02G 15/013 174/58 |
| 7,442,884 | B2 * | 10/2008 | Ball | H02G 15/113 16/2.2 |
| 8,621,796 | B2 * | 1/2014 | Egritepe | F16L 7/02 52/220.8 |
| 8,735,744 | B2 * | 5/2014 | Schwartz | H02G 15/007 439/578 |
| 10,451,463 | B2 * | 10/2019 | Rautenberg | G01N 29/024 |
| 10,461,463 | B2 * | 10/2019 | Schoenfeld | H01R 13/518 |
| 11,710,925 | B2 * | 7/2023 | Cottin | H01R 13/582 439/465 |
| 2016/0336097 | A1 * | 11/2016 | Sakagami | H02G 15/013 |
| 2022/0149563 | A1 * | 5/2022 | Cottin | H01R 13/582 |

* cited by examiner

SEAL THAT EMBRACES THE ELECTRICAL CONDUCTORS THAT CROSS THROUGH THE WELLHEAD AND DEVICE COMPRISING THE SAME

TECHNICAL FIELD

The present invention refers to an elastomeric seal that embraces the electrical conductors that pass through the wellhead, which comprises an upper cylindrical portion, a lower frustoconical portion, one to three through holes, which longitudinally cross the seal and one to three longitudinal cuts that go from the periphery of said through holes to the periphery of the seal. In an alternative of the invention, the seal comprises more than one through hole, a longitudinal cut that goes from the periphery of one of the through holes to the periphery of the seal and one or two longitudinal cuts that go from the periphery of one of said through holes to the periphery of another through hole.

Similarly, part of the present invention is a modular mechanical device for sealing conductive elements that pass through wellheads that includes the elastomeric seal defined in the previous paragraph, with which a high pressure hermetic seal barrier is achieved that allows the passage of electrical conductors or of any kind through the wellhead without the need for cuts and/or cable joints inside or outside the well and without junction boxes attached to the wellhead, making it possible to electrically connect equipment located inside the well, maintaining the pressure and safety integrity inside it.

BACKGROUND OF THE INVENTION

In oil and gas wells, fluids usually do not reach the surface by themselves, which is why there are different artificial lift systems, among which are Electro Submersible Pumps (ESP) and Progressive Cavity Electric Pumps (PCP), which when the oil is heavy (low API viscosity), need to be supplemented with electric heaters located at the bottom of the well in order to lighten the product and make it easier to extract.

Because these devices are electrical, they need to be connected to energy sources outside the well, which is performed through electrical conductive elements (cables) that go from the inside to the outside of the well. The introduction of these elements generates the need to use systems that allow the conductors to pass through the wellheads and isolate the pressure inside them, in order to communicate the interior of the well with external electricity sources while guaranteeing the internal pressure thereof.

The first systems designed and used by the industry are called closed capsule electrical penetrators, such as the one disclosed in U.S. Pat. No. 4,693,534, this system uses three subsystems for its installation, the first called lower connector, which is attached to the production cable through an electrical joint, it is installed under the pipe hanger and joins the second subsystem called penetrator, through a female-male threaded connection system with an electrical contact inside. Likewise, this penetrator is connected to a third subsystem called a top or surface connector using the same female-male threaded connection system with electrical contacts inside. According to this patent, for the installation of the lower connector it is necessary to cut the production cable and splice the system below the head and the hanger, inside the well, all these mentioned contacts and splices create hot spots and generate a risk of short circuit electrical failure. In addition, due to the number of components and its complex installation, it takes up to 4 hours to install and if there is rain or excessive humidity in the environment, the system cannot be installed with operational safety because the humidity affects the electrical contacts and the adhesive materials (tapes) used.

Subsequently, to avoid cuts and splices below the head, epoxy-sealed penetrators without cable cut were designed, including those reported in patent CA 2838733, where users have the alternative of not cutting the conductors inside the well, since they use the principle of not making electrical connections in the pressurized area. However, it is necessary to cut the cable on the outside to assemble the system and, therefore, it is necessary to make an electrical connection on the outside surface of the well in the explosion risk area, which is why electrical connection boxes with explosion-proof specifications must be used, making installation and subsequent work more time-consuming, difficult and risky.

In addition, part of the system reported in CA 2838733 is located below the pipe hanger on the inside of the wellhead, using a one-piece adapter that is installed through said pipe hanger. Its sealing system is a capsule that uses epoxy gaskets and putties; however, these types of seals feature reliability problems due to the fact that the assembly procedure requires controlled environmental conditions and requires an epoxy mixture with complex and specialized procedures that, if not carried out correctly, do not achieve uniform seals that guarantee hermeticity and therefore, leaks are generated. On the other hand, since the main seal system is installed at the bottom of the hanger, there is a potential risk of shock damage when lowering and seating the hanger.

However, in the state of the art there are also mechanical seal systems without cable cutting, such as the one defined in the Colombian application CO11-162242, which, like the previous seals, offer the user the possibility of not cutting the conductor cables inside the well. This type of seal eliminates the use of epoxides and generates a mechanical seal based on the use of elastomeric gaskets with conical and/or cylindrical geometric shapes, located on seal seats with coincident conical and/or cylindrical holes, through which they pass the cables, which when pushed by the mechanical action in their assembly, exert inadequate pressure on the gaskets, and these, in turn, transmit it to the cable, generating a high risk of damage to it, as a result of an exaggerated tightening force. Like the previous systems, these are installed under the hanger, generating the same or greater risk of damage from knocks when the hanger is set, since its inner capsule has an even larger diameter than the epoxy seal system. In addition, like the previous system, it is necessary to cut the cable on the outside to assemble the system and therefore, it is necessary to make an electrical connection on the outside surface of the well in the explosion risk area, reason why electrical connection boxes with explosion-proof specifications must be used, making their installation and subsequent work more time-consuming, difficult and risky and also features the same disadvantages as mentioned above.

Mechanical systems have also been designed that seal above the hanger, outside the head, as shown in patent applications CO 13-122315, CO 13-261118 and CO 15-224941, this type of mechanical seal is similar in its sealing concept to the one mentioned in the previous paragraph and avoids the risk of internal damage when placing the hanger, but like the two systems referenced above, it is necessary to cut the cable on the outside to assemble the system and therefore, it is necessary to make an electrical connection in the outer surface of the well, specifically in the area at risk of explosion, which is why electrical connection boxes with explosion-proof specifications must be used, making installation and subsequent work more time-consuming, difficult, costly and risky, and featuring the same disadvantages as mentioned above.

Likewise, a pressed seal system is found in the state of the art, as taught in patent application CO 15-084754, which shows a seal system that, as in the two previous documents, is located outside the well, requires cable cutting and the use of external connection boxes attached to the head. Similarly, it features a shortcoming in its installation system, since it uses a cable gland system that forces its elastomeric seal system to forcibly enter a considerably long space with a smaller diameter, generating a latent risk of damage to the cable by rubbing and friction, which means that, as in the previous systems, it is necessary to cut the cable on the outside to assemble the system and therefore, it is necessary to make an electrical connection on the outside surface of the well, in the explosion risk area, which is why electrical connection boxes must be used, which has the aforementioned disadvantages.

In summary, the initial systems cut the cables under the head, to overcome the operational risks associated with the installation, new systems have been developed, but all of them require cutting the cable on the surface and must use an external connection box attached to the well with the aforementioned disadvantages.

Lastly, patent U.S. Pat. No. 6,530,433 B2 is found in the state of the art, which discloses a mechanical system pressed by screws, which refers to a series of rings that are compressed by a gland cover secured by means of screws, its seal system is done through mechanical expansion, which is used for low pressures, which puts hermeticity at risk, since it does not support pressures greater than 5 MPa. In addition, it is an assembly system designed for a single hanger, which makes it not adaptable to other wellhead systems.

Considering the above information, the objective of this invention is to provide an elastomeric seal and a device that includes it, which are easy to place, eliminate the risks and shortcomings of each of the exposed technologies and systems, do not require any type of internal or external cutting in the cable or the use of connection boxes adhered to the outside of the wellhead, which are adaptable to different types of wellheads and maintain the integrity of the well in a safe and controlled manner.

Advantages of the Invention

The seal and the device of the present patent application have the following advantages with respect to the existing devices in the state of the art:

1. The elastomeric seal comprises a single piece with a special geometric and physical shape that allows it to be installed around the electrical conductors to be sealed, minimizing the number of pieces to be installed.
2. The device is composed of only four components, making its assembly simple and fast, to the point that its installation takes 10 minutes or less.
3. Its installation does not require the cable to be cut either inside or outside the well.
4. As no cuts are required in the conductor on the outside, the conductor can be connected to the remote area of the well (safe zone) without requiring the use of a junction box attached to the wellhead.
5. The device is inside the head, preventing unauthorized manipulation or intentional damage by external agents of the stamp unit.
6. The device creates a compact seal unit, which is compressed by mechanical action in a short stroke, without the use of presses.
7. The device seals each of the electrical conductors (cables) in configurations of 1 to 3 cables at the same time, withstanding pressures up to 35 MPa in ideal conditions.
8. Due to its simple configuration of only four components, it becomes the most economical option for sealing conductors at the wellhead.

DESCRIPTION OF THE INVENTION

Figure 1A:
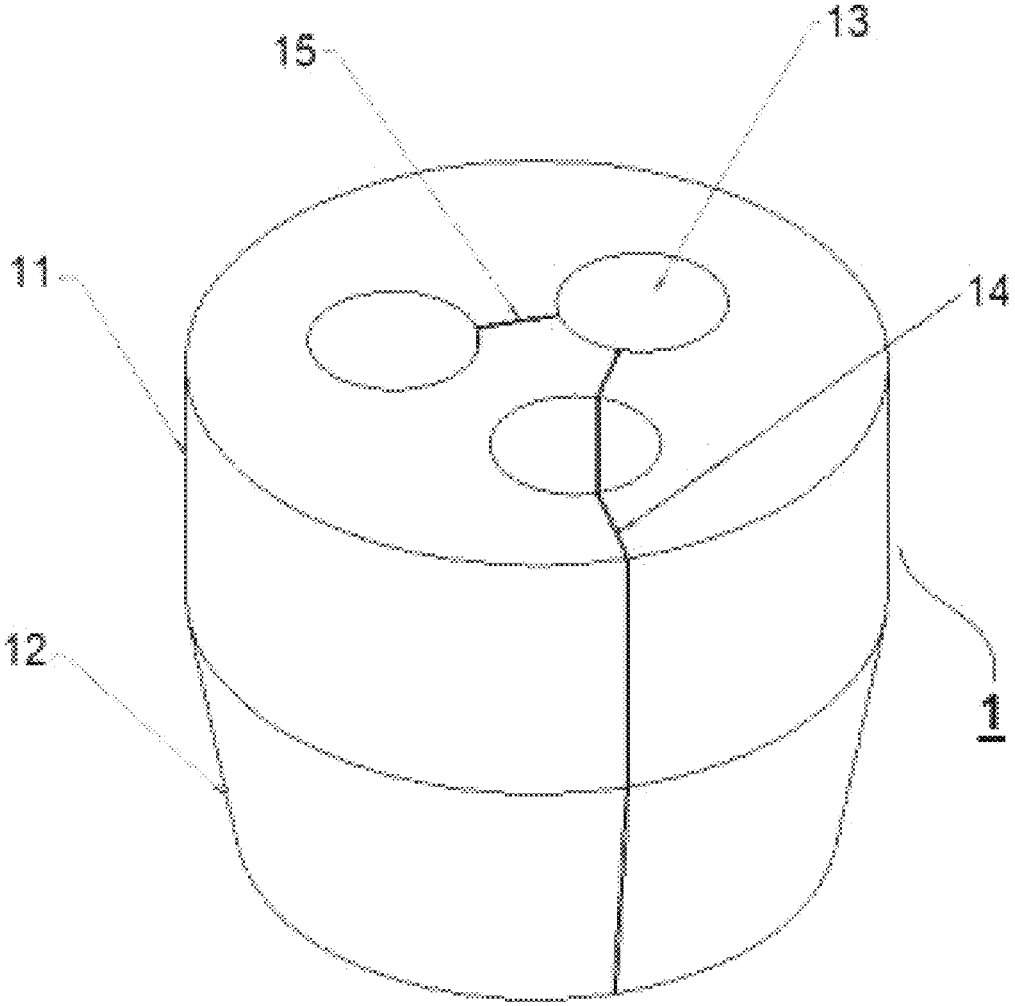
FIG. 1A shows a perspective view of the preferred embodiment of the elastomeric seal of the present invention, in which the seal comprises three through holes, a longitudinal cut that goes from the periphery of one of the through holes to the periphery of the seal and two longitudinal cuts that go from the periphery of one of said through holes to the periphery of another through hole.

The present invention refers to an elastomeric seal (1), made of elastic or polymeric material, which embraces the electrical conductors (5) that cross the wellhead, said seal comprises an upper cylindrical portion (11), a lower portion in a frustoconical shape (12), one to three through holes (13), which longitudinally cross the seal (1) and one to three longitudinal cuts that go from the periphery of said through holes to the seal periphery (14).

Usually, the electrical equipment used inside the well uses medium voltage electrical sources, which require the use of three-phase cable systems (6), that is, they use three phases or electrical conduction cables (5), which makes it necessary to have seals in which each electrical conductor (6) can be sealed individually or the set of two or three phases can be sealed at the same time.

In an alternative of the invention, the seal (1) comprises a through hole (13) and a longitudinal cut that goes from the periphery of one of the through holes to the seal periphery (14). Thus, the seal (1) opens longitudinally to allow the passage of the electrical conductor (5) through it and allow it to be located in the through hole (13).

Figure 1B:
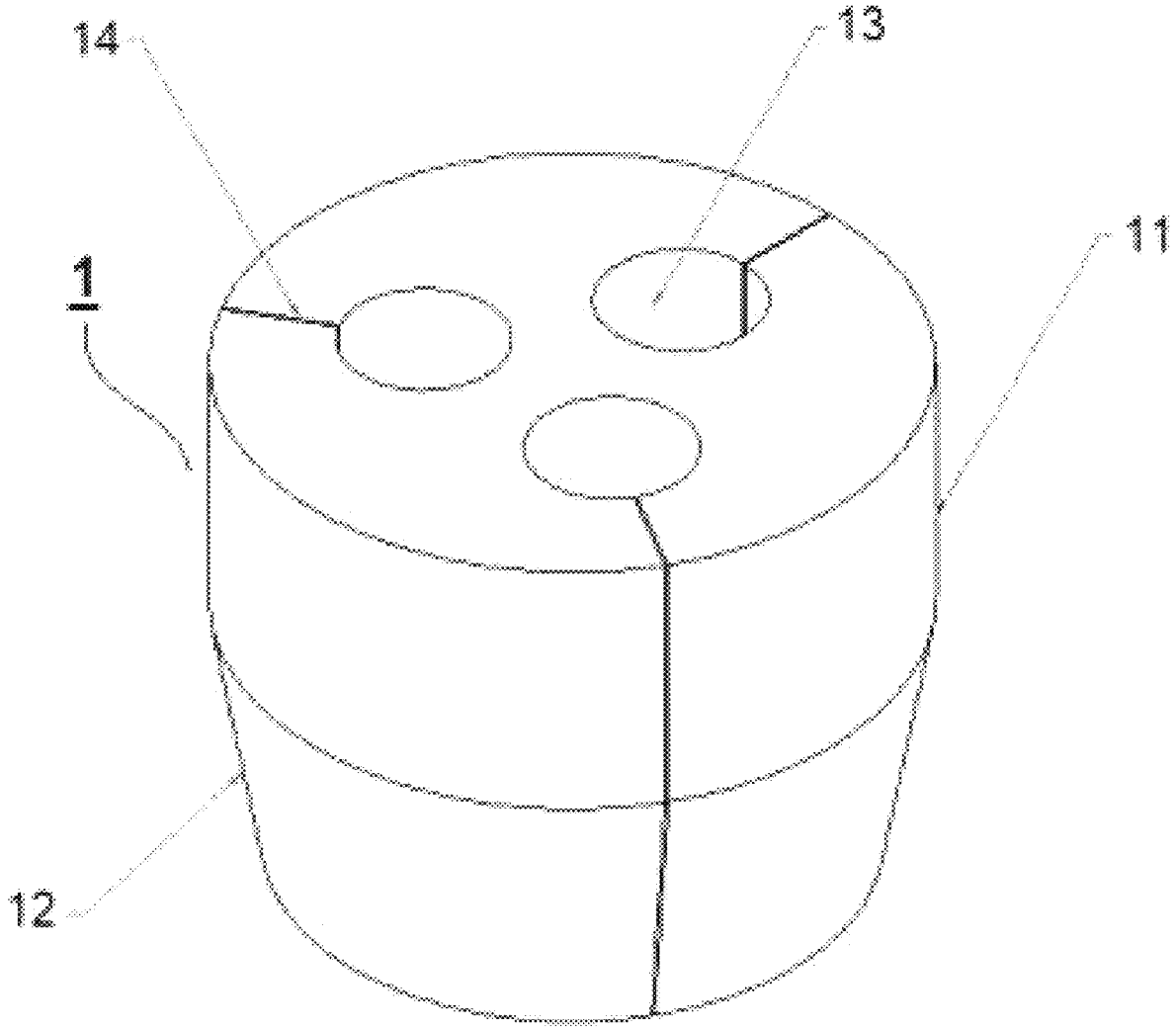
FIG. 1B shows a perspective view of another embodiment of the elastomeric seal of the present invention, in which the seal comprises three through holes and three longitudinal cuts that go from the periphery of said through holes to the periphery of the seal.

In the preferred alternative of the invention, which is shown in FIG. 1, the seal (1) comprises more than one through hole (13), preferably three through holes (13), a longitudinal cut that goes from the periphery of one of the through holes to the seal periphery (14) and one or two longitudinal cuts that go from the periphery of one of said through holes to the periphery of another through hole (15). In this case, the elastomeric seal (1) opens as shown in FIG. 3, to allow the location of each phase or cable of the electrical conductor system in a through hole (13).

Figure 2:
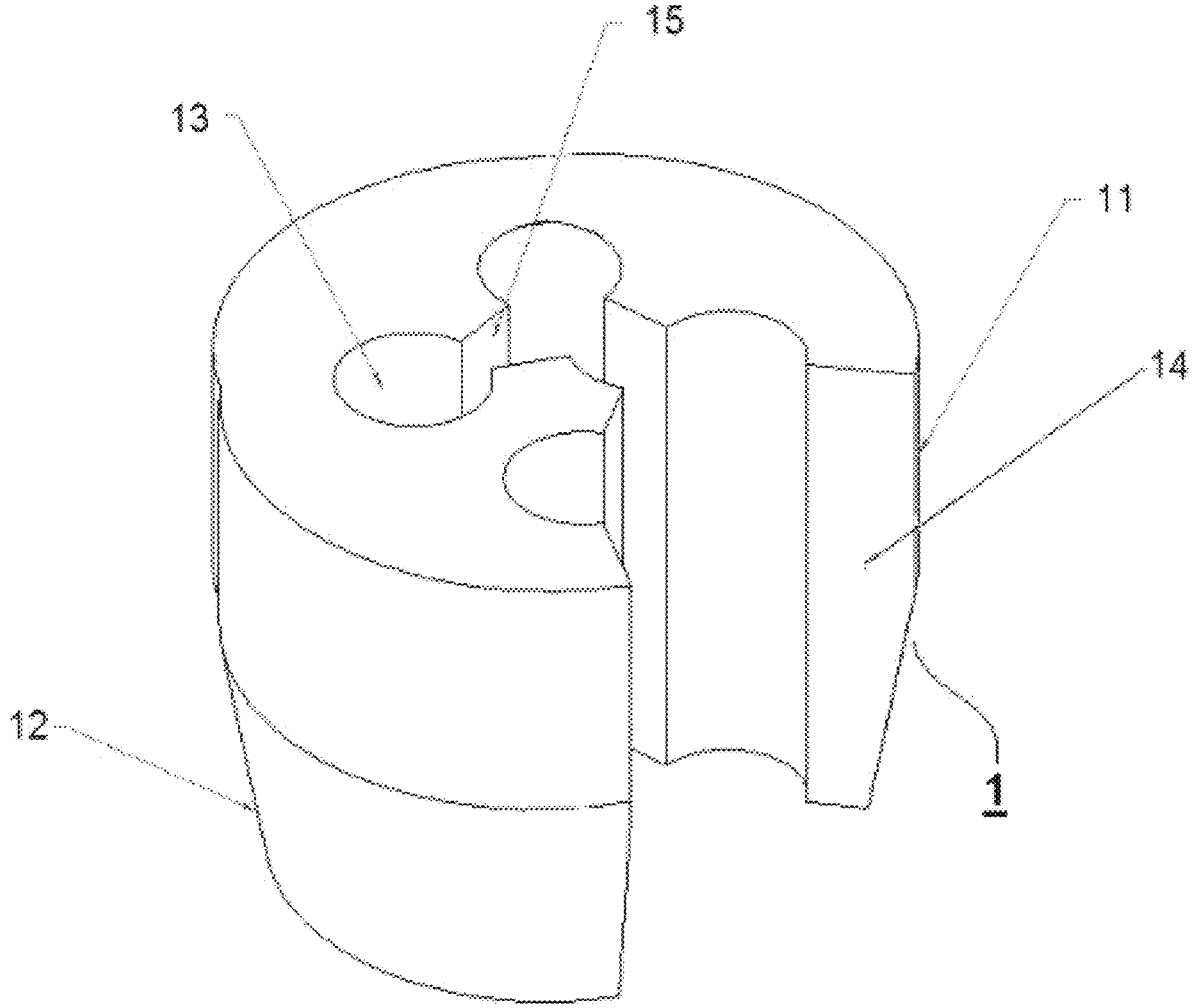
FIG. 2 shows the perspective view of the elastomeric seal of FIG. 1A, open to receive the electrical conductors.

Similarly, part of the invention is the alternative in which the seal (1) comprises more than one through hole (13), preferably three through holes (13), and three longitudinal cuts that go from the periphery of one of the through holes up to the seal periphery (14), as illustrated in FIG. 2, thereby allowing the location of each phase or cable of the electrical conductor system in a through hole (13).

Figure 3:
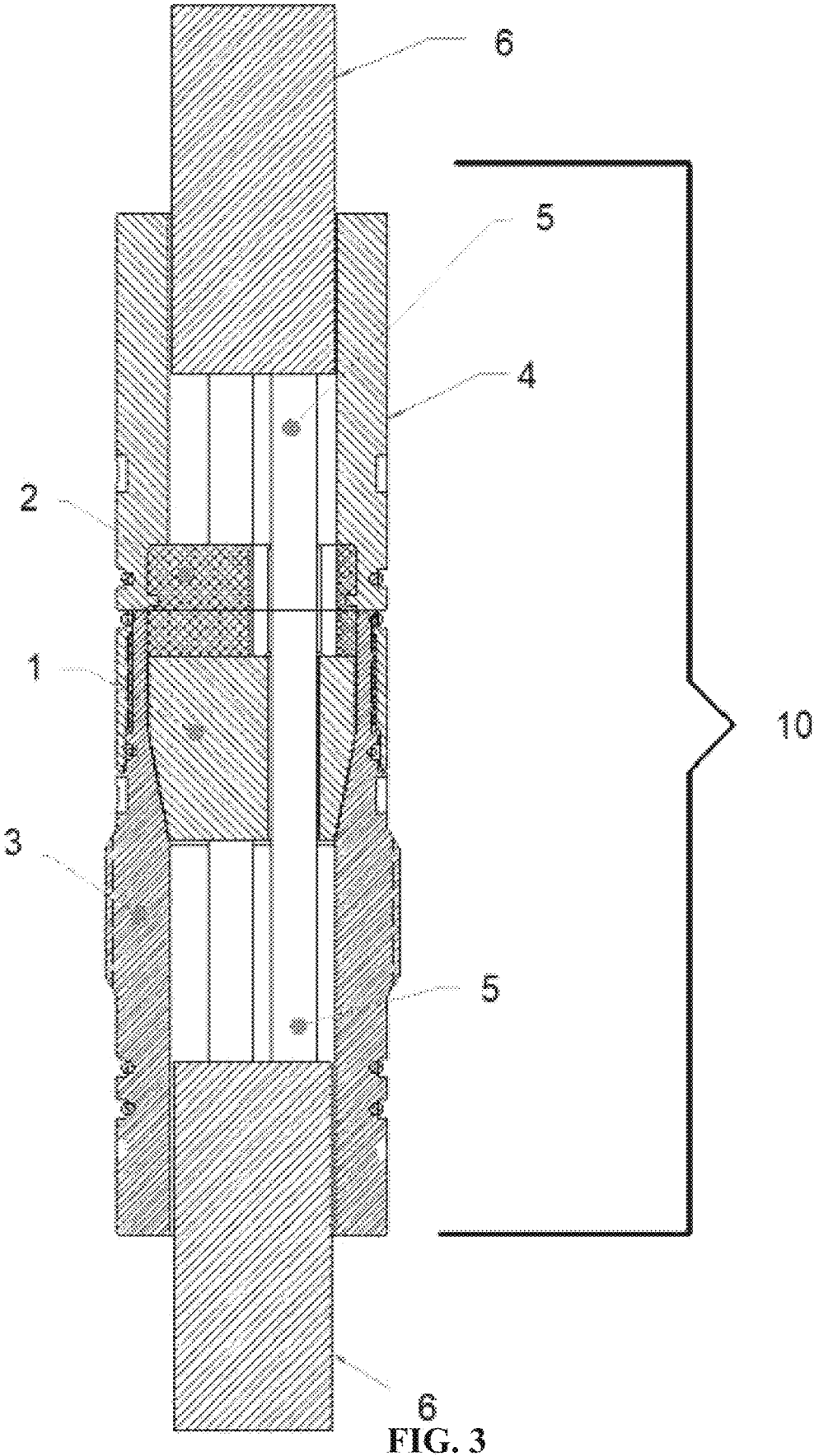
FIG. 3 shows the longitudinal section of the device that comprises the seal of the present invention with the elastomeric seal of the present invention, a retaining ring, a seal chamber and a seal chamber cover, it also shows a conductor cable that passes through its interior and each of its phases to be sealed.
Figure 4:
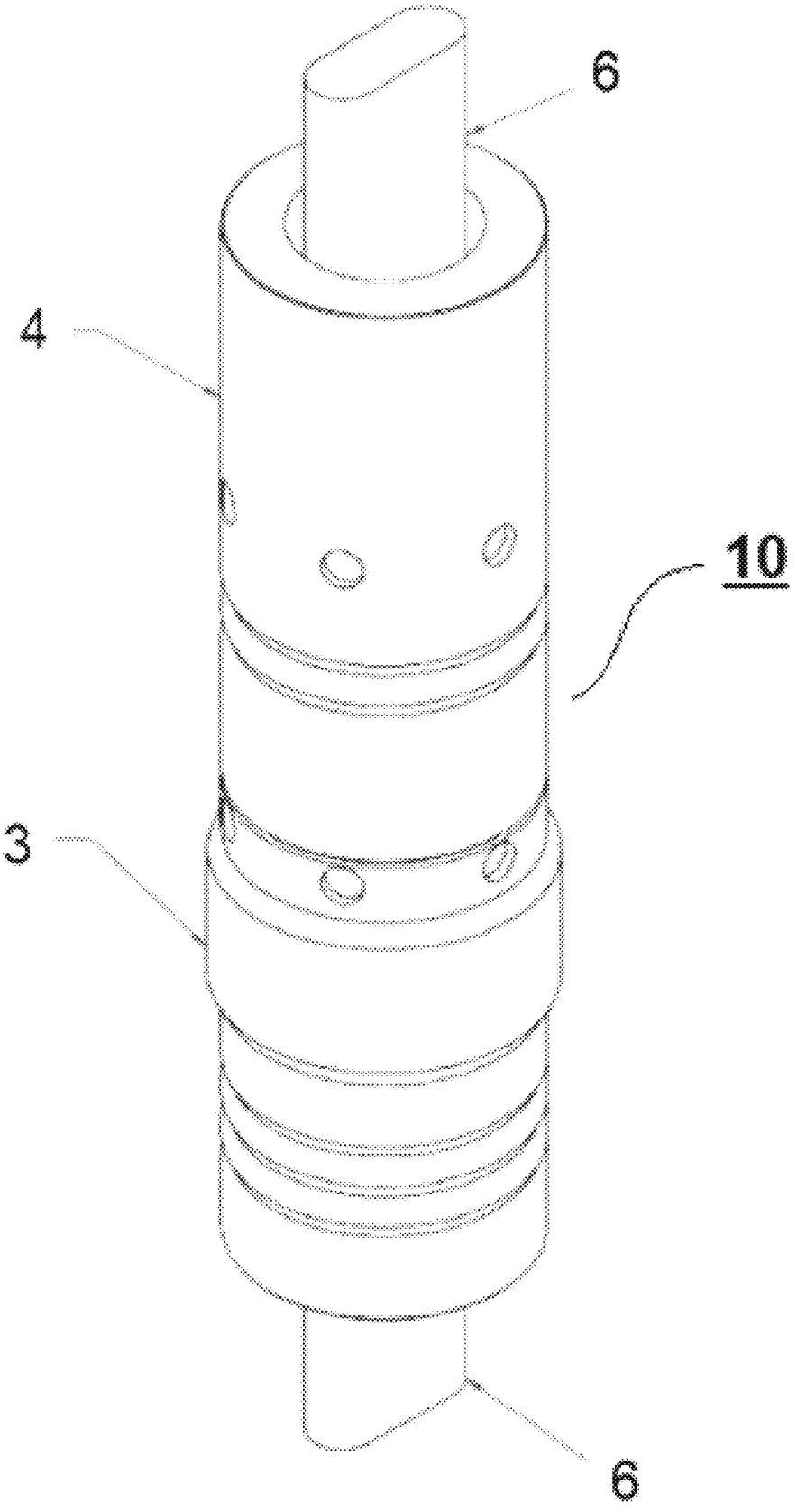
FIG. 4 shows a perspective view of the device object of the invention, where the seal chamber attached to the seal chamber cover and the conductor system passing through the device can be seen.
Figure 9:
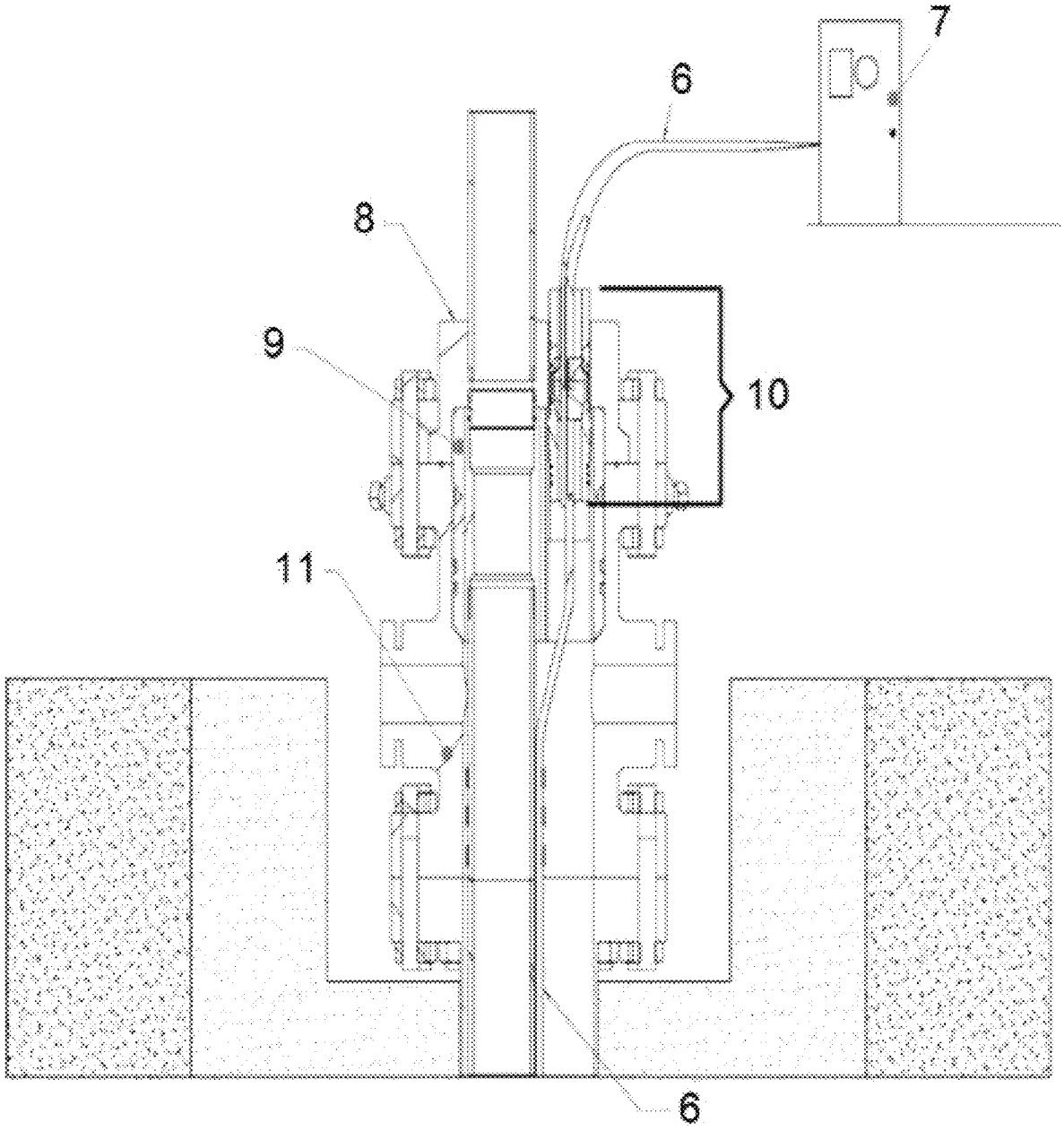
FIG. 9 shows the longitudinal section of a wellhead with the device of the present invention, where the electrical power cable that comes from the bottom of the well passes through the device of the invention being housed in the pipe hanger, sealing the well and allowing the cable to connect to the external electrical source, without losing pressure integrity at the wellhead and without cutting the cable or using junction boxes adhered to the upper wellhead section.

Likewise, part of the present invention is a modular mechanical device (10) to seal conductive elements that pass through wellheads that includes the elastomeric seal (1), defined in the previous paragraphs, which is located just below a modular retaining ring system (2), whose parts are mechanically assembled, the elastomeric seal (1) together with the retaining ring (2) are located inside a seal chamber (3) and this chamber (3) fits through a threaded system with a seal chamber cover (4), as shown in FIG. 3. These last two elements, the seal chamber (3) and the seal chamber cover (4), have variable external geometries that allow it to be adapted and assembled to heads of different sizes and different types of hangers (9), as can be seen in FIG. 4 and FIG. 9.

Figure 5:
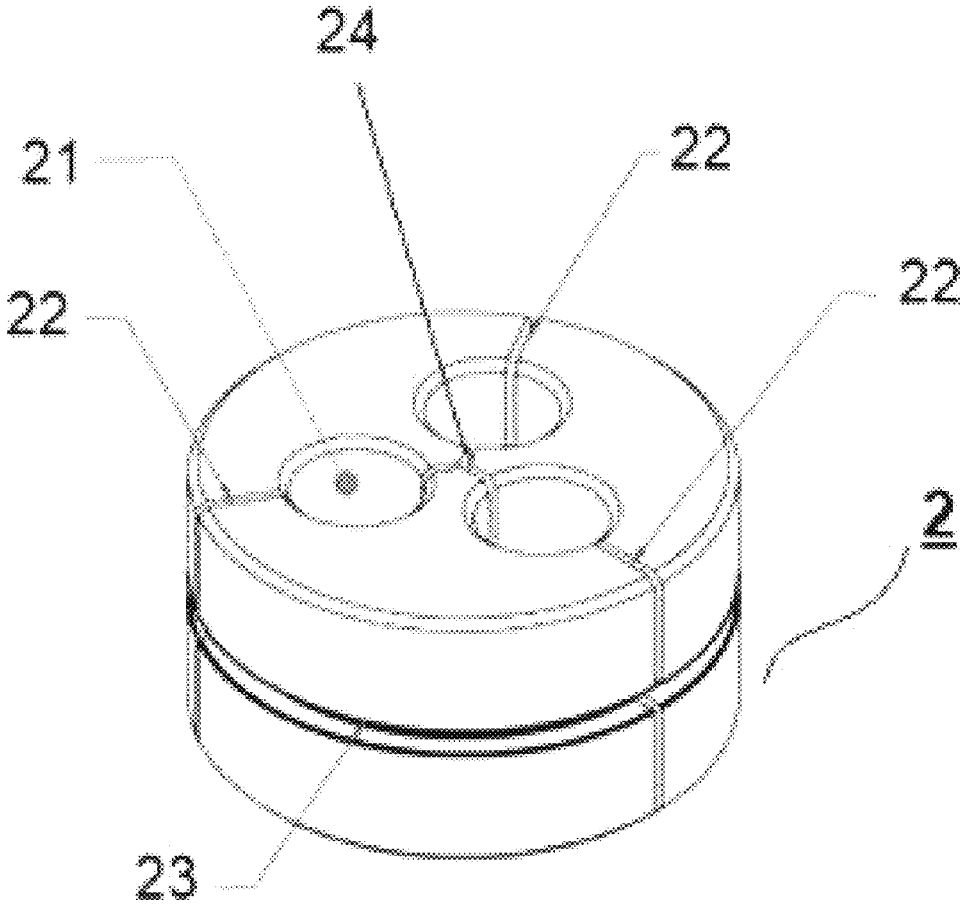
FIG. 5 shows a perspective view of the retaining ring that is part of the device of the present invention.

Now, the retaining ring (2), which is shown in detail in FIG. 5, is made of non-conductive material (dielectric), its external shape is cylindrical compatible with the internal seal area (31) of the seal chamber (3), comprises one to three through holes (21), through which the electrical conductors (5) pass, one to six cuts (22) that communicate the holes with the outer diameter, one to three cuts (24) that communicate the through holes (21) with each other, and one to three grooves to house the same number of seal rings (23), preferably, said seal rings or gaskets are O-rings.

Figure 6:
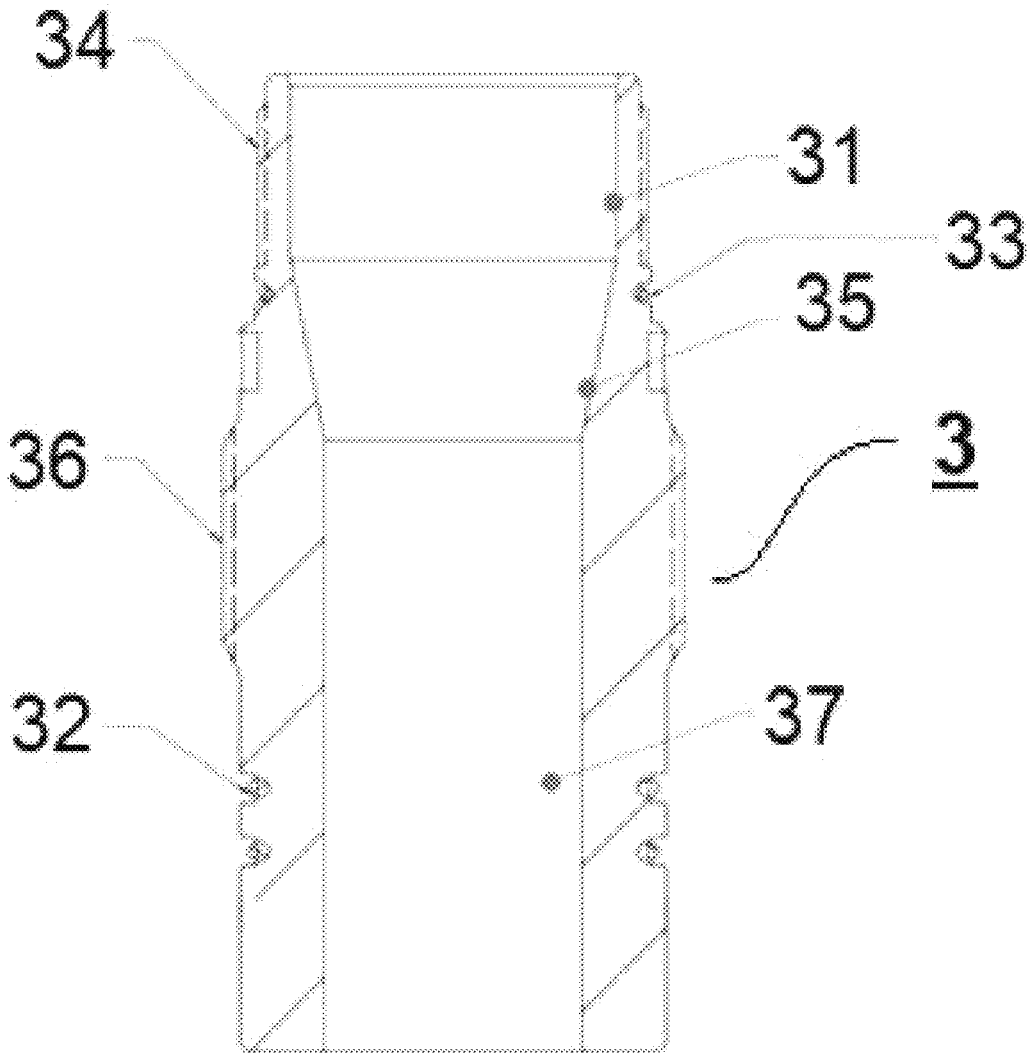
FIG. 6 shows a longitudinal section of the seal chamber.

For its part, the seal chamber (3), shown in FIG. 6, comprises from top to bottom a first seal area (31), where the retaining ring (2) is housed, which presents on its external surface a thread system (34) and one or more housings for the ring seal (33), which is attached to the seal chamber cover (4); under the first seal area a second seal area (35) is located, where the elastomeric seal unit (1) is located; then, it has a thread system (36) on the external surface that adapts and joins the different types of pipe hanger (9); then on the same external surface it has one or several housings for seal rings (32) that seal against the pipe hanger (9), and under the second seal area (35), it has an internal passage area (37), through which the electric cable (6) or the electric conductors (5) pass.

Figure 7:
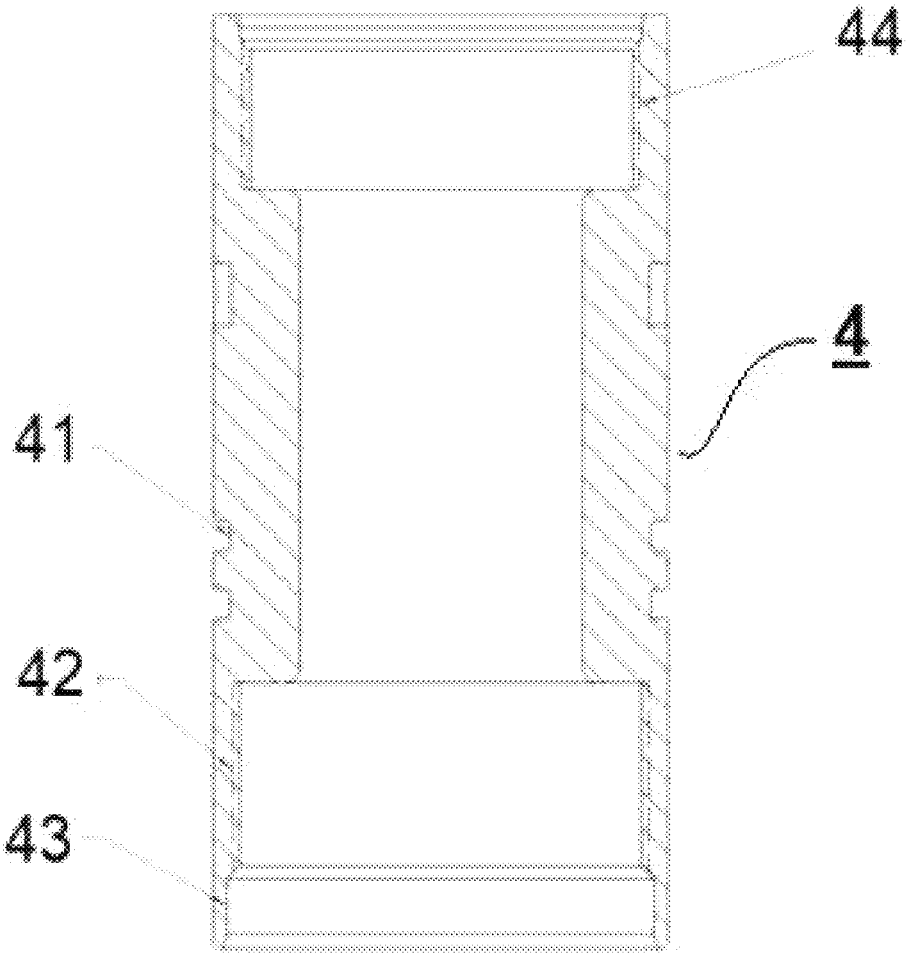
FIG. 7 shows a longitudinal section of the seal chamber cover.

Complementing the seal chamber (3), the device comprises a seal chamber cover (4), shown in FIG. 7, which has on its outer surface one to five seats for seal rings (41), which seal against a through hole in the upper section of the wellhead (8), one or two thread systems (42, 44), which adapt and assemble to one or two seal chambers (3), in the latter option, the thread (42) of the cover receives the thread (34) of a first seal chamber (3) and the thread (44) of said cover receives the thread (36) of a second seal chamber (3), and one or two seal areas (43).

In the device of the present invention, the seal chamber (3) and the seal chamber cover (4) are made of metallic material with essentially cylindrical internal and external shapes, except for the area (35) that receives the lower portion of the seal (1) and has a frustoconical shape.

Figure 8:
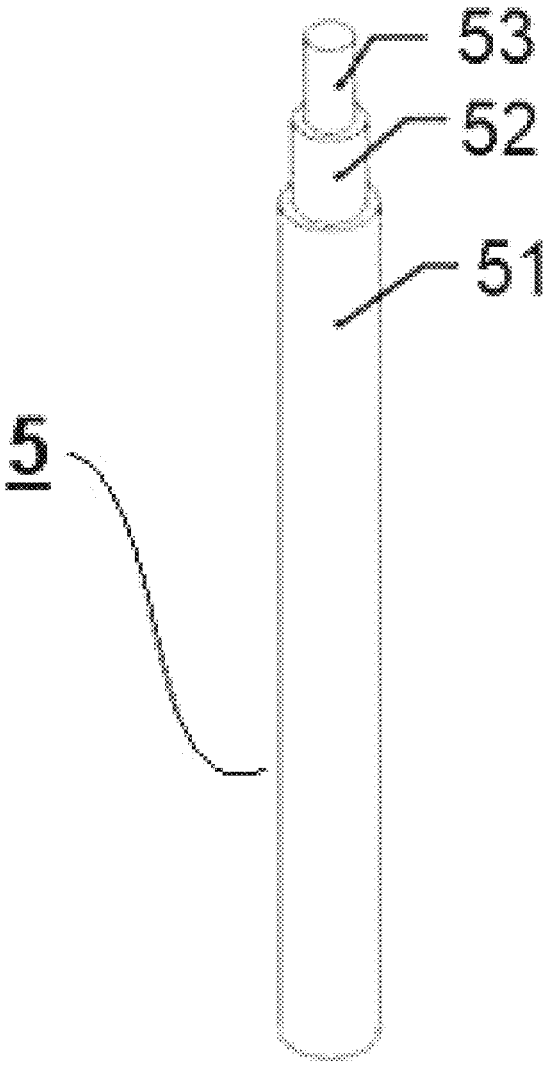
FIG. 8 shows a perspective of the physical structure of each of the three conductors that form a typical power cable for electrical submersible pumps (ESP).

Finally, FIG. 8 shows the typical electrical conductors (5) for electro-submersible pumps (BES), which are composed of a central conductor copper core (53) with a dielectric insulation of Ethylene Propylene Diene Type M (EPDM) (52) and a lead mechanical protection (51).

During its operation, the seal chamber (3) that joins and seals the pipe hanger (9), which houses inside it the elastomeric seal (1) being compressed towards the electrical conductor(s) (5), by means of a retaining ring (2) and the union and closure of the seal chamber cover (4) threaded in the upper part of the seal chamber (3), where the outer part of the seal chamber cover (4) joins and seals with the top of the wellhead (8).

The version of the modular mechanical device (10) to use will depend on the configuration of the wellhead. If a concentric pipe hanger (9) with three individual holes is used, where the sealing device to be used is the one that has an elastomeric seal (1) with a single through hole (13), which receives a single conductor (5), which is located so that it coincides with said hanger hole, passing a single electrical conductor (5) through each hole (13) and each device (10), making it necessary to have three devices (10), or if an eccentric pipe hanger (9) is used with a single hole where it will use a single sealing and/or repair device through which the three electrical conductors (5) will pass at the same time, which are located in three through holes (13). The latter is the most widely used embodiment of the invention and which will serve as a reference in the different Figures of the device (10).

In the same way, the device of the invention (10) can be used from one to three times in line, one above the other, joining the thread (36) of the seal chamber (3) of a second or third device with the system thread (44) of the seal chamber cover (4) of the first or second device, in order to increase the resistance to pressure, making redundant or backup barriers.

When two devices are joined, the device will comprise two chambers (3), with their respective elastomeric seals (1) and retaining rings (2), and two seal chamber covers (4), where the thread (42) of the first cover (4) receives the thread (34) of the first seal chamber (3) and the thread (44) of the first cover (4) receives the thread (36) of a second seal chamber (3), the thread (34) of the second seal chamber (3) is screwed into the thread (42) of the second cover (4) and the thread system (36) of the first seal chamber (3) is fixed to the hanger of pipe (9) located between the lower section of the wellhead (11) and the upper section of the wellhead (8), where through the use of seal rings (o-rings) it closes.

In the case where three devices are joined, the modular mechanical device (10) will comprise three chambers (3), with their respective elastomeric seals (1) and retaining rings (2), and three seal chamber covers (4), where the thread (42) of the first cover (4) receives the thread (34) of the first seal chamber (3), the thread (44) of the first cover (4) receives the thread (36) of a second seal chamber (3), the thread (34) of the second seal chamber (3) is screwed into the thread (42) of the second cover (4), the thread (44) of the second cover (4) receives the thread (36) of a third seal chamber (3), the thread (34) of the third seal chamber (3) is threaded in the thread (42) of the third cover (4), and the system of thread (36) of the first seal chamber (3) is fixed to the pipe hanger (9) located between the lower section of the wellhead (11) and the upper section of the wellhead (8), where through the use of ring seals (o-rings) it closes.

Specifically, FIG. 9 shows a generic and commonly used wellhead, where the electrical conductors or cables (6) coming from the bottom of the well pass through the device (10) object of the invention to be sealed inside, the device is threaded and sealed to the pipe hanger (9) located between the lower section of the wellhead (11) and the upper section of the wellhead (8), where through the use of O-rings it closes, seals and gives pressure integrity to the wellhead, allowing the cable (6) to connect with the remote external electrical source (7) maintaining hydraulic control and pressure integrity between the well and the external atmosphere.

Example 1. Operation of the Elastomeric Seal (1) and the Device (10) Containing it In accordance with the previous description of components, we can illustrate its operation as follows:

a. The device (10) is installed starting with the seal chamber (3) being screwed into the upper part of the pipe hanger (9),
b. The conductor cable (6) that comes from the bottom of the well is removed from the metal shell that holds it together in the area where it is going to be sealed, in order to release and expose the electrical conductor(s) (5), then it passes through the inside of the seal chamber (3),
c. The elastomeric seal (1) is opened through its cuts and the conductor or conductors (5) are introduced through the cuts (14) and (15) and are located in the through holes (13), in such a way that said seal embraces the conductors without being necessary to break the circuit, which is why the seal can be installed any length from the conductor cable (6) regardless the amount of cable before or after the seal area,
d. The elastomeric seal (1) is slid into the seal area (35) inside the seal chamber (3),
e. The retaining ring (2) is installed on top of the elastomeric seal (1),
f. The seal chamber cover (4) is installed and threaded on the thread (34) of the seal chamber (3), the cover (4) pushes the ring (2) and compresses the elastomeric seal (1), closing the space and creating an airtight barrier seal.

The components of the device object of this invention can be placed in line or in series of two or even three complete devices one above the other, in order to increase the sealing force, generating backup barriers and thus making the system more reliable according to the requirements of the end user.

Assembled in series of one, two or three devices, the cable (6) can be connected to the external power unit (7) without requiring any type of additional connection box attached to the wellhead.

The invention claimed is:

1. An elastomeric seal (1) for electrical conductors (5) passing through a wellhead, comprising:

a body having an upper cylindrical portion (11) and a lower frustoconical portion (12);
a first through hole, a second through hole and a third through hole, each of which longitudinally crosses the elastomeric seal (1);
a first longitudinal cut between the periphery of the first through hole and the periphery of the second through hole;
a second longitudinal cut between the periphery of the second through hole and the periphery of the third through hole;
a third longitudinal cut between the periphery of the third through hole and the periphery of the elastomeric seal;
wherein each of the longitudinal cuts are adapted to open the body of the elastomeric seal longitudinally in order to provide access thereto to a cable or an electrical conductor and allow the cable or electrical conductor to be placed in the corresponding through hole.

2. The elastomeric seal (1) according to claim 1, characterized in that it is made of elastic or polymeric material.

3. A modular mechanical device (10) for sealing conductive elements passing through wellheads comprising:
an elastomeric seal (1);
a modular retaining ring system (2) located on the elastomeric seal (1), said seal (1) together with the retaining ring (2) being placed inside a seal chamber (3) and being adjusted by means of a threaded system with a seal chamber cover (4); and
wherein the elastomeric seal comprises an upper cylindrical portion, a lower frustoconical portion, a first through hole, a second through hole and a third through hole, each of which longitudinally crosses the elastomeric seal, a first longitudinal cut between the periphery of the first through hole and the periphery of the second through hole, a second longitudinal cut between the periphery of the second through hole and the periphery of the third through hole, a third longitudinal cut between the periphery of the third through hole and the periphery of the elastomeric seal;
wherein each of the longitudinal cuts are adapted to open the elastomeric seal longitudinally in order to provide access thereto to a cable or an electrical conductor.

4. The modular mechanical device (10) according to claim 3, characterized in that the retaining ring (2) is modular and comprises one to three through holes (21), through which the electrical conductors (5) pass, one to six cuts (22) that communicate the holes with the outer diameter, one to three cuts (24) that communicate the through holes (21) with each other, and one to three grooves to house the same number of seal rings (23).

5. The modular mechanical device (10) according to claim 4, characterized in that the retaining ring (2) is made of electrically non-conductive material (dielectric) and has a cylindrical external shape compatible with the internal seal area (31) of the seal chamber (3).

6. The modular mechanical device (10) according to claim 4, characterized in that the seal rings or gaskets of the retaining ring (2) are O-rings.

7. The modular mechanical device (10) according to claim 6, characterized in that the seal chamber (3) comprises from top to bottom a first seal area (31) where the retaining ring (2) is housed, which features on its external surface a thread system (34) and one or several housings for the ring seal (33), which is attached to the seal chamber cover (4); under the first seal area a second seal area (35) is located, where the elastomeric seal unit (1) is located; then, it has a thread system (36) on the external surface that adapts and joins the different types of pipe hanger (9); then, on the same external surface it has one or several housings for seal rings (32) that seal against the pipe hanger (9), and under the second seal area (35), it has an internal passage area (37), through which the electric cable (6) or the electric conductors (5) pass.

8. The modular mechanical device (10) according to claim 3, characterized in that the seal chamber cover (4) comprises on its outer surface one to five housings for seal rings (41), which seal against a through hole in the upper section of the wellhead (8), one or two thread systems (42, 44), which adapt and assemble one or two seal chambers (3) and one or two seal areas (43), which house the upper part of the retaining ring (2).

9. The modular mechanical device (10) according to claim 7 or 8, characterized in that the seal chamber (3) and the seal chamber cover (4) are made of metallic material with internal and external shapes essentially cylindrical, except for the area (35) that receives the lower portion of the seal (1) having a frustoconical shape.

10. The modular mechanical device (10) according to claim 3, characterized in that it is threaded and sealed by means of its thread system (36) to the pipe hanger (9) located between the lower section (11) of the wellhead and the upper section (8) of the wellhead, where through the use of O-rings it closes, seals and provides pressure integrity to the wellhead, allowing the cable (6) coming from inside the well to be connected to the remote external power source (7).

11. The modular mechanical device (10) according to claim 3, comprising two chambers (3), with their respective elastomeric seals (1) and retaining rings (2), and two seal chamber covers (4), where the thread (42) of the first cover (4) receives the thread (34) of the first seal chamber (3) and the thread (44) of the first cover (4) receives the thread (36) of a second seal chamber (3), the thread (34) of the second seal chamber (3) is screwed into the thread (42) of the second cover (4) and the thread system (36) of the first seal chamber (3) is fixed to the pipe hanger (9) located between the lower section (11) of the wellhead and the upper section (8) of the wellhead, where through the use of ring seals (O-rings) it closes.

12. The modular mechanical device (10) according to claim 3, comprising three chambers (3), with their respective elastomeric seals (1) and retaining rings (2), and three seal chamber covers (4), where the thread (42) of the first cover (4) receives the thread (34) of the first seal chamber (3), the thread (44) of the first cover (4) receives the thread (36) of a second seal chamber (3), the thread (34) of the second seal chamber (3) is screwed into the thread (42) of the second cover (4), the thread (44) of the second cover (4) receives the thread (36) of a third seal chamber (3), the thread (34) of the third seal chamber (3) is threaded in the thread (42) of the third cover (4), and the thread system (36) of the first seal chamber (3) is fixed to the pipe hanger (9) located between the lower section (11) of the wellhead and the upper section (8) of the wellhead, where through the use of ring seals (O-rings) it closes.

* * * * *